United States Patent [19]

Walsh

[11] 4,227,113

[45] Oct. 7, 1980

[54] INCANDESCENT ELECTRIC LAMP WITH PARTIAL LIGHT TRANSMITTING COATING

[75] Inventor: Peter Walsh, Stirling, N.J.

[73] Assignee: Duro-Test Corporation, North Bergen, N.J.

[21] Appl. No.: 952,266

[22] Filed: Oct. 18, 1978

[51] Int. Cl.[2] ..... H01K 1/14; H01K 1/26; H01K 1/32

[52] U.S. Cl. ..... 313/112; 313/114

[58] Field of Search ..... 313/112, 113, 114

[56] References Cited

U.S. PATENT DOCUMENTS

| | | | |
|---|---|---|---|
| 1,342,894 | 6/1920 | Bugbee | 313/114 X |
| 2,121,314 | 6/1938 | Birdseye et al. | 313/114 |
| 2,144,400 | 1/1939 | Birdseye | 313/114 X |
| 2,488,751 | 11/1949 | Verbeek et al. | 313/113 |
| 2,622,222 | 12/1952 | Hageman et al. | 313/114 |
| 2,859,369 | 11/1958 | Williams et al. | 313/112 X |
| 3,209,188 | 9/1965 | Freeman | 313/112 X |
| 3,209,192 | 9/1965 | Decker | 313/112 X |
| 4,039,878 | 8/1977 | Eijkelboom et al. | 313/112 X |

FOREIGN PATENT DOCUMENTS 1017828 1/1966 United Kingdom .

*Primary Examiner*—Palmer C. Demeo
*Attorney, Agent, or Firm*—Darby & Darby

[57] ABSTRACT

An incandescent lamp of a type in which infrared (IR) energy is to be reflected back to the filament. The lamp has one section which is coated with an IR reflecting material which also will transmit visible light and another section coated with material which has a high reflectivity to IR energy and a low transmissivity to visible light. The filament is mounted off-center of the optical image axis of the envelope and substantially all of the energy in the visible light range exits from the envelope in no more than two passes.

15 Claims, 4 Drawing Figures

INCANDESCENT ELECTRIC LAMP WITH PARTIAL LIGHT TRANSMITTING COATING

Incandescent lamps of the type wherein infrared (IR) energy is to be reflected back to the filament have been discussed for years. In such lamps, the envelope is of a particular shape, for example, spherical or ellipsoidal. The lamp envelope is provided with an arrangement, usually a coating on a wall of the envelope, for reflecting IR energy and for transmitting visible energy. The filament is positioned with respect to the envelope so that the IR energy reflected by the coating will be directed back to the filament.

Various types of coatings for the envelope have been proposed. One of these is an envelope which is fully coated with a very thin layer of silver or other reflective metal so that the visible light energy will be transmitted therethrough. Such a metal coating, by itself, is generally not considered to be adequate since if it is to reflect a sufficient amount of IR energy back to the filament, the coating must be relatively thick, in which case visible energy cannot efficiently be transmitted therethrough.

Another coating material which has been proposed is titanium dioxide ($TiO_2$). Such material has also been generally found not to be satisfactory since it does not have a very high coefficient of reflection for IR energy.

Another type of coating is formed by three separate and discrete films, these films illustratively being titanium dioxide, silver and titanium dioxide ($TiO_2/Ag/TiO_2$), which are coated over the entire surface area of the envelope. It has been found that such films can be used advantageously as an IR reflector and visible energy transmitter in an incandescent electric lamp when properly designed to meet the characteristics of the spectrum of energy produced by the incandescent filament. Such a lamp is disclosed in U.S. Pat. No. 4,160,929.

In general, while the $TiO_2/Ag/TiO_2$ coating is satisfactory in a lamp of the type under consideration, it has a disadvantage in that the deposition of the coating over the entire curved surface area of the envelope is somewhat costly.

Consequently, in accordance with the subject invention, it is desired to minimize the area of the envelope over which this coating must be deposited. It has been found that an efficient IR reflecting lamp can be made in which the coating of IR reflecting and visible light transmitting material need not be deposited over the entire inner surface of the envelope. Instead, it has been found that a portion of the surface of the envelope, generally up to about one-half, can be covered with a material which has very poor visible light transmitting properties but very high IR reflective properties. One such material is a relatively thick coating of silver.

It has further been found that the combination of a coating which is highly reflective to IR energy and has poor transmission to energy in the visible range with a coating which has both high IR reflectivity and high transmissivity in the visible range can also operate when the filament is deliberately located off, rather than on, its optical image axis This considerably simplifies the manufacture of the lamp since it is not necessary to precisely optically center the filament in the envelope.

Accordingly, it is an object of the present invention to provide an incandescent electric lamp having a coating thereon for reflecting IR energy back to the filament, only a part of the coating having a high transmissivity to visible light.

An additional object is to provide an incandescent lamp having a coating for reflecting IR energy back to the filament in which a portion of the coating is made of a metal only and which portion is not highly transmissive to visible light.

An additional object is to provide an incandescent electric lamp having a coating to reflect IR energy produced by the filament back thereto in which a portion of the coating is of a metal, such as silver, which does not transmit any significant portion of visible light energy.

Other objects and advantages of the present invention will become more apparent upon reference to the following specification and annexed drawings in which.

Figure 1:
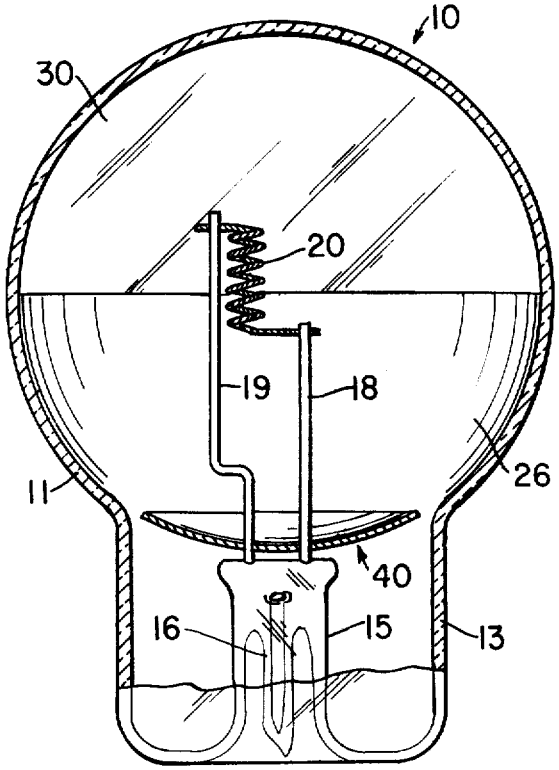
FIG. 1 is an elevational view, partly in section, of a lamp made in accordance with the subject invention.

Referring to FIG. 1, the incandescent lamp 10 of the invention includes an envelope 11 of lime glass, borosilicate glass or other similar material. The envelope is shown as being generally spherical in shape although other optically designed shapes can be used, for example, ellipsoidal, depending upon the shape and placement of the filament.

The envelope 11 has a neck portion 13 which is formed with a reentrant stem 15 having a tubulation 16 therein. The interior of the envelope 11 is exhausted through the tubulation 16 and then filled with a gas, if this is desired. The lamps of the present invention can operate either as a vacuum type or as a gas filled lamp, for example filled with argon, or some other conventional type of gas used with incandescent lamps. A high molecular weight gas, such as krypton, also can be used.

Extending from the stem 15 is a pair of lead-in wires 18 and 19, these wires being relatively stiff and of a suitable material, such as nickel. The bottom ends of the wires are connected to a base of conventional construction, for example of the screw type, or of the bayonet type to make electrical contact therewith, the base being able to be placed into a socket. The base is not shown for purpose of clarity.

A filament 20 is mounted to the lead-ins 18 and 19. The filament preferably has a high emissivity, in the order of 0.5 or better. The filament is shown as being elongated and vertically mounted. However it can be mounted in other directions, e.g. horizontally, and can have other shapes, e.g. partially circular. The filament is generally of plain or doped tungsten and, to achieve the high emissivity, it is preferably double or triple coiled. Any suitable filament material can be used, this in itself not being critical to the invention. The lead wires 18 and 19 are relatively stiff so that the filament can be held in place. The filament is heated to incandescense, the temperature generally being in the range from about 2700° K. to about 3000° K., depending upon the type of lamp.

The envelope 11 has two types of coatings thereon, these being deignated 26 and 30. In a preferred embodiment of the invention, as shown in FIG. 1, the coatings 26 and 30 each occupy about one-half of the surface area of the envelope 11. The locations of these coatings are discussed in greater detail below. Also, the proportions of the two coating can be varied. The two coatings are also described as being on the inside of the envelope. One or both also can be located on the outside of the envelope.

Considering now the details of the coatings, coating 26 is of a material which is highly reflective to IR but whose visible transmissivity need not be very good. Typical coating materials would be the metals, for example silver, gold and copper. While aluminum can be used, it is not as reflective to IR energy. The advantage of using these metals, particularly silver, is that they can be deposited relatively easily and inexpensively, such as by chemical deposition, in a conventional manner as is now used in connection with making so-called silver-reflector bulbs. When silver is used as the material for coating 26, it is preferred that the thickness be at least about 1000 A° or more to achieve as close to 100% IR reflectivity as possible. Coating 26 does not have to transmit visible light. Therefore, its thickness can be increased to obtain optimum IR reflectivity. It would generally appear to the observer to be opaque.

Other suitable materials for the coating 26 are the alkalai metals, such as lithium, sodium and potassium.

As to the coating 30, the preferably is one which is both highly reflective to IR energy and also highly transmissive to visible energy. That is, while the portion of the envelope having the coating 26 transmits little or no visible light, the portion of the envelope 30 is to transmit as much of the visible light as possible so that it can be transmitted out through the envelope through the area covered by the coating 30. This coating would generally appear to the observer to be transparent.

The coating 30 is preferably of a type which is set forth in copending application Ser. No. 781,355, filed Mar. 7, 1977, now U.S. Pat. No. 4,160,929 granted July 10, 1979, which is assigned to the assignee and comprises three discrete film layers, two of a dielectric which sandwich the third film, a metal, therebetween. Another suitable coating is set forth in my copending application Ser. No. 863,155, filed Dec. 22, 1977, also assigned to the assignee, which comprises two films of metal, such as silver, sandwiching a dielectric to form so-called etalon coating. Other coatings can be used. In general, the coating for the area 30 should have a reflectivity of at least about 60% of the IR energy incident thereon and a transmissivity of visible energy of also at least about 60% there through. Of course, the higher the IR reflectivity and visible transmissivity, the greater will be the efficiency of the lamp.

Figure 2:
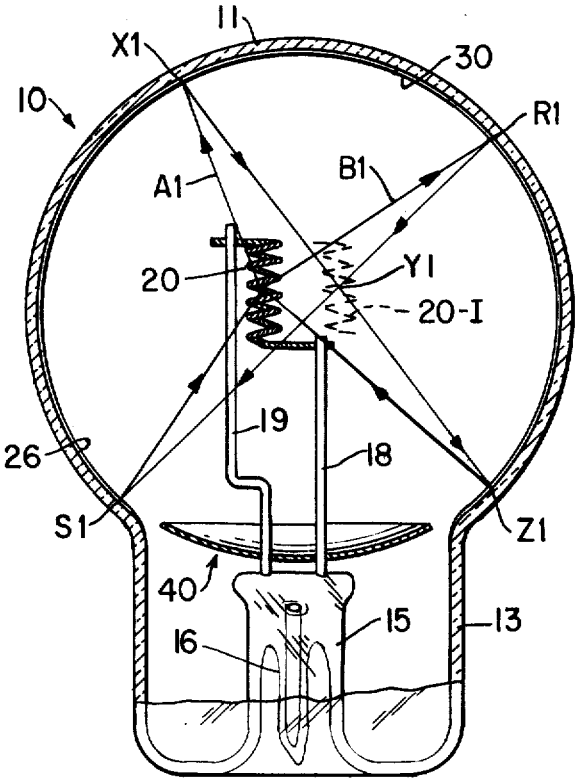
FIG. 2 is a diagrammatic view illustratively of the operation of the lamp of FIG. 1.

Reference is made to FIG. 2 which diagrammatically illustrates the operation of the invention. It is preferred, to achieve manufacturing advantages, that the filament 20 not be precisely located at the optical center of the envelope. In fact, the filament is deliberately located off its optical image axis formed by the reflector by an amount somewhat greater than the filament diameter. The filament 20 is shown diagrammatically and, since it is off of the optical center of the spherical envelope it has an image axis which is designated as 20-I. Since the envelope 11 is generally spherical, it acts as a spherical lens. Since the filament is not located on the image axis any ray of IR energy originating from any point of the filament will pass through the corresponding point of the image 20-I and return to the same point of the filament, generally after no more than two passes off the envelope wall. Consider, for example, a ray designated A1 which originates from a point near the top end of the filament 20. This ray impinges on the envelope wall at point $X_1$, from which both the visible and IR energy is reflected, and then passes through the bottom point of the image of the filament 20-I at point $Y_1$, to the other side of the envelope wall at point $Z_1$ from which the IR energy is returned to the filament at the point where it originated. The energy in the visible region leaves the envelope at point $Z_1$. A ray $B_1$ originating from the point on the filament but going in a different direction impinges upon the wall at point $R_1$, where the visible energy exits, makes a trip across the envelope to point $S_1$ on the filament image 20-I and then returns to the same point on the filament 20.

A similar analysis holds for substantially every other point on the filament. The majority of rays of IR energy will be returned to the filament after only two reflections from the envelope wall. In most instances, there will be one reflection from an area with the coating 26 and another reflection from an area with coating 30, the reflection from either surface occurring first. This analysis holds except for those rays emitted to a direction which is into the lamp base and stem area. To reflect these rays, a reflector 40, which is of silver or other highly IR reflective material, is mounted at the bottom of the envelope on stem 15. Reflector 40 is curved to act as a lens to focus impinging rays of IR energy back to the filament. Thus, substantially all of the IR energy produced by the filament, less that which is transmitted through or absorbed by coatings 26 and 30, is reflected back to the filament, causing its operating temperature to be increased.

Since the majority of rays emitted by the off-center filament 20 makes only one reflection from the silver coated surface 26, very little of the visible light energy will be lost before it leaves the envelope. This is particularly true where the material 26 is silver, which has a low absorption to visible energy. The visible energy reflected from the coating 26 will be transmitted out of the envelope through the visible light transmitting coating 30 at its next pass. If the original direction of the ray, for example ray $B_1$, is such that it first impinges on the area covered by the coating 30, then the visible energy is transmitted directly through the envelope and only the IR energy is reflected to the coating 26 from which it is reflected to the filament 20. Thus, of the visible energy produced by the filament, all of it (less the amount absorbed) is transmitted through the coating 30 after no more than two passes, one of these first being off of coating 26 for about one-half of the rays.

The analysis below considers the efficiency of the lamp. The quantities r and v are used to refer to the highly reflective coating 26 and to the visible transmitting coating 30, respectively. The wattage emission A from the filament is:

$$A = P_o + (1-\epsilon)(C_v + C_r) \quad (1)$$

where:

$P_o$ = the power emitted from the filament at its operating temperature, without coatings;

$\epsilon$ = the emissivity of the filament;

$C_v = R_v B_r = R_v R_r A_r$ $C_r = R_r B_v = R_r R_v A_v$ $C_v$, $C_r$ = the power reflecting on the second pass from coating 30 or coating 26, respectively;

$B_v$, $B_r$ = the power reflecting on the first pass from coating 30 or coating 26, respectively;

$A_v$, $A_r$ = the power leaving the filament toward coating 30 or coating 26, respectively;

$R_v$, $R_r$ = the effective reflectivity of coating 30 or coating 26, respectively.

If the filament displacement off of the optical image axis is not large, then $A_1 = A_r = A/2$ $$A = P_o + R_v R_r A(1-\epsilon)$$

$$A = (P_o/1-(1-\epsilon)R_v R_r) \quad (3)$$

The output power is O, given by:

$$O = O_1 + O_2$$

$$T_v B_r + T_v A_v = T_v(1 + R_v)\frac{A}{2}$$

$$O = \frac{T_v(1 + R_v)}{2} \quad \frac{P_o}{(1 - (1 - \epsilon) R_v R_r)}$$

$J_v$ is the transmittance to IR of the coating 30. The total input power P is:

$$P = A - C = (1 - R_v R_r)A$$

$$P = \frac{(1 - R_v R_r)P_o}{(1 - (1 - \epsilon)R_v R_r)} \quad (5)$$

The reflectivities $R_v$ and $R_r$ change with wavelength. Thus, the equations for O and P must be used over appropriate wavelength regions, and the final results summed. The output power O need only be computed over the visible range, in order to obtain the luminous output of the lamp, while the input power P must be computed over both the visible and the infrared. When $R_r = 1$, then coating 26 is a perfect reflector to IR and the formulae reduce to that for a completely aligned lamp, even though the filament is actually misaligned.

The inherent advantage that the use of coating 26 over half of the envelope has over a coating 30 over the full envelope is that the coating 26 is designed for only one function-high reflectivity to IR, while coating 30 must serve two functions-high visible transmission and high infrared reflectivity.

It can be shown that the lamp of FIG. 2 is considerably more efficient in lumens per watt production as compared to an incandescent lamp which uses no coating of any type.

Figure 3:
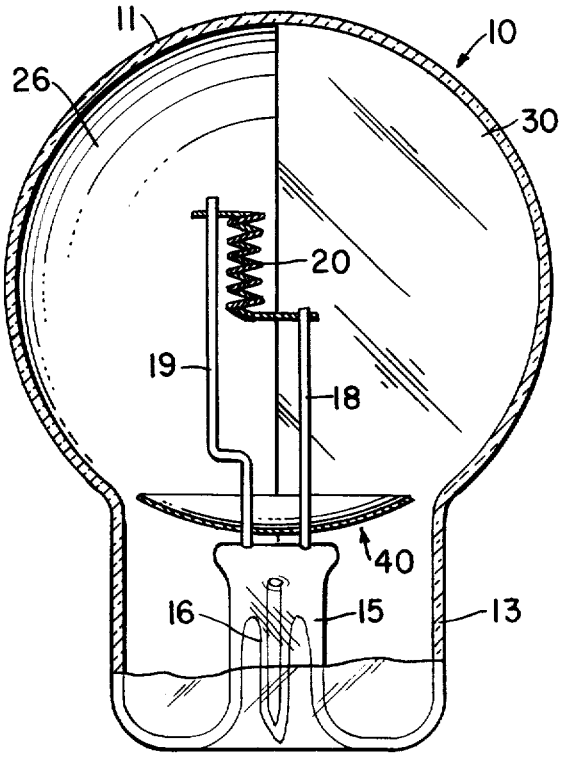
FIGS. 3–4 show other configurations of lamps in accordance with the invention with placement of the metal IR reflecting layer.
Figure 4:
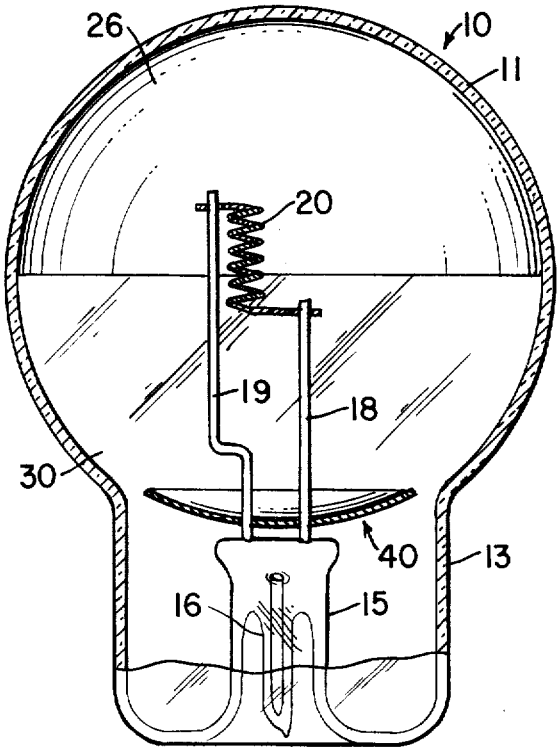

It should be noted that the visible light transmission through the lamp envelope is directive, that is, light comes out only through that part of the envelope having the coating 30. It is therefore possible, to make the non-visible transmitting portion of the coating 26 occupy a selected part of the envelope such that the light can be directed out therefrom. For example, as shown in FIG. 4, the coating 26 can be provided over the upper half of the envelope. When the bulb of FIG. 3 is burned base down (as shown), light will only be directed down. If the bulb of FIG. 3 is burned base up, then the lamp light will be directed upwardly.

If the top half of the bulb is provided with the coating 26, as shown in FIG. 4, the visible light will be directed out through the bottom portion of the envelope. By using the arrangement, highly directive or diffusive light sources can be obtained. These can be used in various types of fixtures, for example, indirect lighting. For example, consider the lamp of FIG. 4 which is burned base up from a ceiling fixture in which the coating 26 is on the top part of the bulb opposite from the base. The light would be transmitted back to the ceiling and then reflected downward.

The lamp of FIG. 1, in which the coatings 26 30 each occupy about one-half the surface area of the envelope as viewed vertically, also has directional advantages. Such a lamp, burned base up or down, can direct the visible light to an area located horizontally from the lamp. The coatings 26, 30 also can be located at various angles with respect to the base.

The reflectivity of the coating 26, for example silver, can be enhanced by the use of dielectric overcoat whose thickness is chosen to provide constructive interference for reflected (visible) radiation. This enhanced reflectivity is fairly insensitive to both the dielectric material used and its exact thickness and, also, the thickness of the silver film.

The reflectivity of a metal film with a dielectric film is developed in the AIP handbook, 2nd Edition, 6, equations 6g–8.

As indicated previously, the proportion of the coatings 26 and 30 can be varied. Generally, the non-visible transmissive coating 26 is kept to a maximum of 50% of the available surface area, although smaller quantities can be used.

While the invention has been described with respect to a lamp in which the filament is purposely misaligned, it also has application to a lamp in which the filament is optically centered.

What is claimed is:

1. An incandescent electric lamp comprising:

an envelope, a filament within said envelope, means for supplying electrical current to said filament to cause it to incandesce and produce energy in both the infrared and visible ranges, the major portion of said envelope being curved and having an optical image axis for said filament, a first coating on a first part of said major portion of said envelope for reflecting the major portion of both the infrared and the visible energy from the filament incident thereon, a second coating on a substantial portion of the remaining part of said major portion of said envelope for reflecting the major portion of the infrared energy from the filament incident thereon and for transmitting therethrough the major portion of the visible energy from the filament incident thereon, said filament being mounted off of said optical image axis, said coatings on said major portion of the envelope both reflecting incident infrared energy back toward said filament, and said first and second coatings being located with respect to said major portion of said envelope so that the infrared energy which is incident thereon and which is reflected is reflected back to impinge upon said filament after two reflections from said coatings.

2. An incandescent electric lamp as in claim 1 wherein the first and second coatings each occupy up to about 50% of the surface area of said major portion of said envelope.

3. An incandescent electric lamp as in claim 2 wherein the lamp further includes a base portion, one of said first and second coatings located on the top portion of the envelope opposite the base and the other located on the bottom portion adjacent the base.

4. An incandescent electric lamp as in claim 2 wherein the first and second coatings each occupy a respective part of the envelope which extends generally vertically of the base.

5. An incandescent electric lamp as in claim 1 wherein said first coating comprises a metal.

6. An incandescent electric lamp as in claim 5 wherein said first coating is of a metal selected from the group consisting of silver, gold, copper and aluminum.

7. An incandescent electric lamp as in claim 5 wherein said first coating is of a metal selected from the group consisting of lithium, sodium and potassium.

8. An incandescent electric lamp as in claim 6 wherein the metal is silver.

9. An incandescent electric lamp as in claim 6 wherein the second coating is of a discrete layer of a metal and a discrete layer of a dielectric film the real part of whose index of refraction of visible light energy matches the imaginary part of the index of refraction of the metal.

10. An incandescent electric lamp as in claim 8 wherein the second coating is of a discrete layer of a metal and a discrete layer of a dielectric film the real part of whose index of refraction to visible light energy matches the imaginary part of the index of refraction of the metal.

11. An incandescent electric lamp as in claim 9 wherein the second coating comprises a discrete layer of silver between two layers of a dielectric.

12. An incandescent electric lamp as in claim 7 wherein the second coating comprises a layer of a dielectric between two layers of silver.

13. An incandescent electric lamp as in claim 1 wherein said major portion of the envelope is symmetrical about said optical axis.

14. An incandescent electric lamp as in claim 1 wherein the visible range energy which is to be transmitted through said second coating is incident thereon after no more than one reflection from said first coating.

15. An incandescent electric lamp as in claim 1 wherein said coatings are placed on the major portion of the envelope such that the infrared energy has one reflection from said first coating and one reflection from said second coating before returning to said filament.

* * * * *